US006439127B1

(12) United States Patent
Cherry

(10) Patent No.: US 6,439,127 B1
(45) Date of Patent: Aug. 27, 2002

(54) PENETRATING PROJECTILE FOR BOMB DISABLEMENT

(75) Inventor: Christopher R. Cherry, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 0 days.

(21) Appl. No.: 09/365,652

(22) Filed: Aug. 2, 1999

(51) Int. Cl.[7] ..... F42B 12/02; F42B 33/06

(52) U.S. Cl. ..... 102/519; 102/402; 102/517; 86/50; 89/1.13; 588/202

(58) Field of Search ..... 102/517, 519, 102/402; 86/49, 50; 473/582–585; 588/202, 203; 89/1.13

(56) References Cited

U.S. PATENT DOCUMENTS

| | | | | |
|---|---|---|---|---|
| 2,355,513 A | * | 8/1944 | Cox | 86/49 |
| 2,491,516 A | * | 12/1949 | Piggot et al. | 86/49 |
| 4,046,055 A | | 9/1977 | McDanolds et al. | |
| 4,169,403 A | | 10/1979 | Hanson | |
| 4,628,819 A | | 12/1986 | Backofen, Jr. et al. | |
| 4,770,102 A | * | 9/1988 | Bisping et al. | 102/506 |
| 4,955,939 A | | 9/1990 | Petrousky et al. | |
| 4,957,027 A | | 9/1990 | Cherry | |
| 5,165,697 A | * | 11/1992 | Lauriski et al. | 473/584 |
| 5,460,154 A | * | 10/1995 | Mattern et al. | 86/50 |

OTHER PUBLICATIONS

Chick, M., et al., "Predictable Disposal of Munitions with Shaped Charges," Materials Research Laboratory, DSTO, Melborne, Australia, date unknown, 1–18.

James, H.R., "TTCP WAG–11 Bullet/Fragment Protocol (Version 2.0)," AWE (Foulness), UK, Nov. 1993, 1–16.

Mader, Charles, et al., "Jet Initiation of Explosives," Los Alamos National Laboratory report LA–8647, Feb. 1981, 1–9.

Moulard, H., "Critical Conditions for Shock Initiation of Detonation by Small Projectile Impact," date unknown, 316–324.

* cited by examiner

*Primary Examiner*—Harold J. Tudor
(74) *Attorney, Agent, or Firm*—George H. Libman; Timothy D. Stanley

(57) ABSTRACT

A specially designed projectile is disclosed which provides an initial cruciform-shaped slit or cut, followed by the creation of a round hole into a target. This controlled entry creates a very high localized pressure during initial impact to a target for a very short duration, followed by a longer sustained lower-impact pressure. This creates a fragment-free hole into the container and can allow the projectile to penetrate sensitive explosives inside the container without shock-initiating or igniting the explosives. The projectile can disable bomb circuitry itself or provide a controlled entry hole to allow low-pressure water or other projectiles incapable of penetrating the steel container to enter freely. The leading end of the projectile can, with a high degree of accuracy, sever wires, destroy batteries, capacitors, and other components within a bomb or select military ordnance. The projectile can be used alone or in tandem with water or other disablement projectiles.

13 Claims, 4 Drawing Sheets

PENETRATING PROJECTILE FOR BOMB DISABLEMENT

BACKGROUND OF THE INVENTION

The field of this invention relates to the disarming of improvised explosive devices (IED's), which are generally housed in hardened enclosures such as steel containers, by penetration of such containers without setting off the bomb.

In the art of bomb disablement, most terrorist-type bombs are diffused remotely by the use of disarmers or disrupters. A disrupter is a tool designed to remotely fire a variety of projectiles into a terrorist bomb to disable or dislodge the circuit and other bomb components without initiating the explosive material comprising the bomb. Water is the most common projectile; however, in order to penetrate hard containers, such as steel, which contain sensitive explosives, (e.g., nitroglycerin/nitroglycol-based dynamites), without shock initiating the explosives, water is not a suitable candidate. The shock that is caused by water which tries to penetrate the steel enclosure of the IED is normally sufficient to set it off.

Various devices are used in explosive ordinance disposal (EOD) and bomb squad environments to disable IED's. U.S. Pat. No. 4,169,403 illustrates the use of several grams of black power electrically initiated to propel liquid out of a barrel to accomplish destruction of an IED. U.S. Pat. No. 4,957,027 discusses the versatility of the nonelectric dearmer and its use in the field of bomb disablement. The technique illustrated involves the firing of many different types of projectiles, such as clay, water, steel-lead shot, steel slugs, hardened steel projectiles, and semisolid materials to disable bombs. In the past, most bomb disrupters used water as the main projectile. The purpose of the water was to deliver a large amount of energy with controlled shock pressures. Most such disrupters are capable of firing projectiles which can penetrate steel containers, such as ammo cans, but the net result is the production of substantially high shock pressures which will shock-initiate sensitive explosives, such as dynamite.

Percussion-actuated, nonelectric (PAN) disrupters are an EOD tool designed specifically to remotely disrupt and render safe IED's. PAN Disrupters can be used one at a time or in groups or in combination with other EOD tools. They can be sequentially initiated to attack different parts of an IED. PAN Disrupters use a shock tube propelled firing pin for cartridge initiation. Depending on the projectile fired, a PAN disrupter system is capable of impacting two or more targets inside the bomb with an isochronicity of 500 microseconds or less. Disrupters are constructed from tough, corrosion-resistant materials such as stainless steel, and are preferably heat-treated to provide a combination of maximum yield strength and toughness.

FIG. 1 illustrates a cross-section view of a PAN disrupter of a type that has been known in the art. FIG. 2 illustrates the breech end of the disrupter in greater detail. The disrupter has a barrel 10 and a breech assembly 12. The barrel is generally 24" long and can have a taper so that the maximum wall thickness in the breech end 12 provides strength yet the overall disrupter weight is reduced because of the taper. The barrel length is generally an optimization between projectile performance and overall unit weight for ease of handling. The barrel 10 is chambered to receive a shell 14. Custom shells can be used or, in the situation of a PAN disrupter, standard commercial or custom-modified shotgun shells can be used. Commercial shotgun shells are generally designed to produce pressures within recommended safe maximum pressure levels of approximately 11,500–15,000 psi. The PAN disrupter shown in FIGS. 1 and 2 is designed to withstand repeated firing of loads which can produce peak chamber pressures in excess of 20,000 psi. The internal bore 16 has a polished finish which provides a seal to expanding gas pressure during shell firing and ensures uniform reproducible performance. Harder abrasive projectiles are preloaded into a protective shot cup inside the shell 14. External knurling on the barrel 10 is another feature of PAN disrupters to allow mounting to stands or robots.

The breech assembly 12 contains an internal shock tube-initiated firing pin system 20. There is no external or internal hammer/firing spring or trigger mechanism so as to provide additional protection against inadvertent discharge if the disrupter is dropped. The disrupter uses gas pressure from the shock tube 18 to actuate the firing pin assembly 20. The firing pin is retained from the shotshell primer by a spring. The firing pin 20 requires about 300 psi of gas pressure channeled through a small steel orifice to actuate the shotshell primer. A recess 24 in the rear of the breech 12 provides protection for the shock tube assembly 18 during recoil. The shock tube assembly 18 provides a quick and easy means to fasten the shock tube 18 to the disrupter. A water plug 26 isolates the water 28 which is in the barrel 10 in bore 16.

When used in the past, PAN disrupters would have an end cap at the end of the barrel 10 opposite the breech 12 such that when the shell 14 was set off with the shock tube 18, the developed pressure would propel the water and the end cap out of the bore 16 and into the target IED to disable it. While this technique proved useful for IED's without external hardened casings such as steel ammo cans, what is now needed to handle steel-encased IED's is a new technique which forms an object of the present invention. That technique allows penetration of hardened enclosures such as steel ammo cans without setting off sensitive explosives contained therein adjacent to the inside wall of the container. Thus, an objective of the present invention is to provide a projectile which can be fired through the hardened enclosure to defeat circuits or generally disrupt an IED without setting it off. Another object of the present invention is to provide a projectile which can accomplish this purpose which can be made from readily available materials. Yet another object of the invention is to develop a projectile that can be used alone, in tandem, or in multiple combinations with other disablement projectiles or tools. Yet another object is to provide a projectile with controlled shock pressures so that it can penetrate steel containers without fragmentation and further penetrate sensitive explosives in direct contact with the steel container without initiation. Yet another object of the invention is to teach a projectile which has a frangible component so that upon impacting the target, it separates into its constituent components to prevent plugging the entry hole made by its leading end and therefore allowing a liquid or other projectile following through to have disruption capability. Yet another object of the present invention is to provide for a penetrating projectile which can deliver listening devices, explosives or other objects for military and paramilitary applications.

SUMMARY OF THE INVENTION

A specially designed projectile is disclosed which provides an initial cruciform-shaped slit or cut, followed by the creation of a round hole into a target. This controlled entry creates a very high localized pressure during initial impact to a target for a very short duration, followed by a longer sustained lower-impact pressure. This creates a fragment-free hole into the container and can allow the projectile to penetrate sensitive explosives inside the bomb without shock-initiating or igniting the explosives. The projectile can disable bomb circuitry itself or provide a controlled entry hole to allow low-pressure water or other projectiles incapable of penetrating the steel container to enter freely. The leading end of the projectile can, with a high degree of accuracy, sever wires, destroy batteries, capacitors, and other components within a bomb or select military ordnance. The projectile can be used alone or in tandem with water or other disablement projectiles.

DETAILED DESCRIPTION OF THE INVENTION EMBODIMENT

When a disrupter is fired against an IED, it accelerates a projectile, such as water, lead shot, clay, steel, or other materials, toward the target to disrupt the circuit or other bomb components. If not properly controlled, the projectile can penetrate into the explosive inside the bomb. Upon such impact, the projectile can induce pressure into the target and in the projectile. In the field of EOD, this impact pressure and its duration needs to be carefully controlled. If the pressure is too high or the duration too long, the projectile has the capability of shock-initiating the explosives inside the bomb. Thus, the purpose of the projectile P of the present invention, which has been given the name Sherwood Special™ by its inventor, is to provide, in the context of an EOD bomb-disablement operation, the ability to penetrate hardened containers, such as steel, that are filled with sensitive explosives, such as nitroglycerin/nitroglycol-based dynamites, without initiating the explosives and to provide a portal or window for water-jet or other fluids or materials to follow through the hole made by the projectile P. The projectile P accomplishes this by controlling the shock pressures and time duration. Impact pressures and their relative time histories, or impulse due to a projectile P impacting the target, is a function of the target density, target shock velocity, projectile density, projectile shock velocity, projectile diameter/shape, and the projectile's velocity upon impact. For a given target, the impact pressures and their related time historics or impulse due to a projectile impacting a target (at the projectile/target interface) can be related by the following equation:

$$P_i=\rho v^2 d \tag{1}$$

where $P_i$ is the impact pressure time history, ρ is the projectile's density, v is the projectile's velocity, and d is the diameter of the projectile which corresponds to the time differential or duration of the impact pressure.

Figure 3:
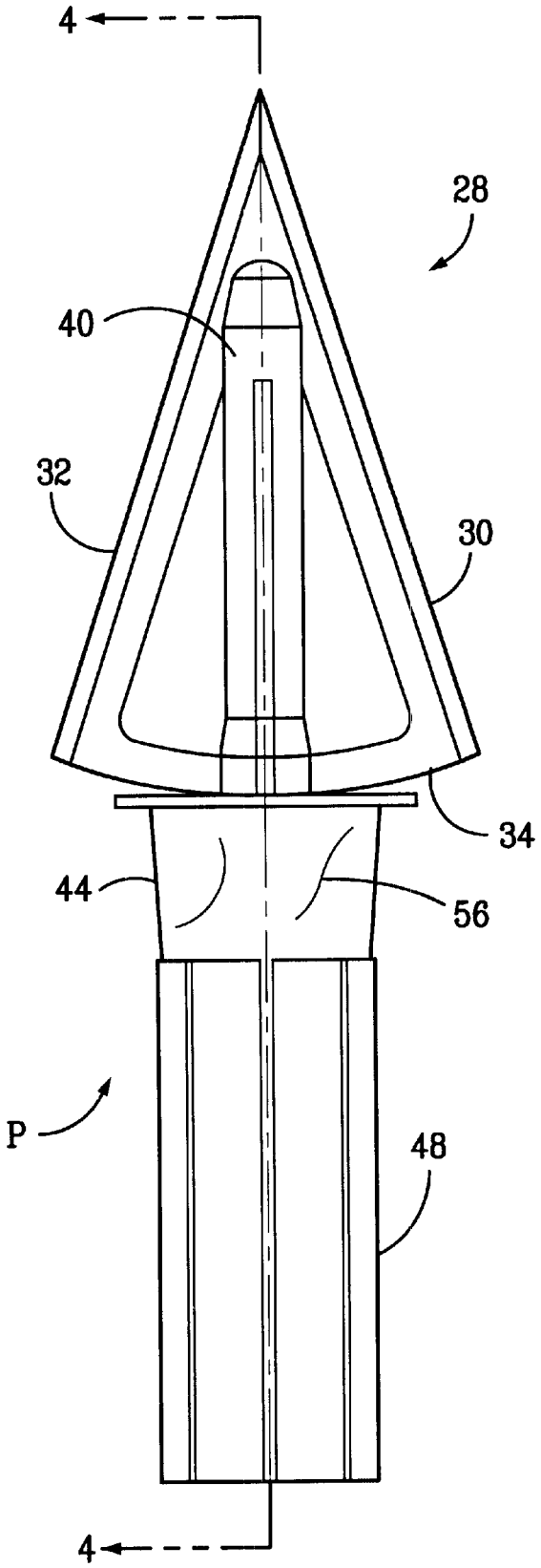
FIG. 3 is a side view of the projectile of the present invention.
Figure 4:
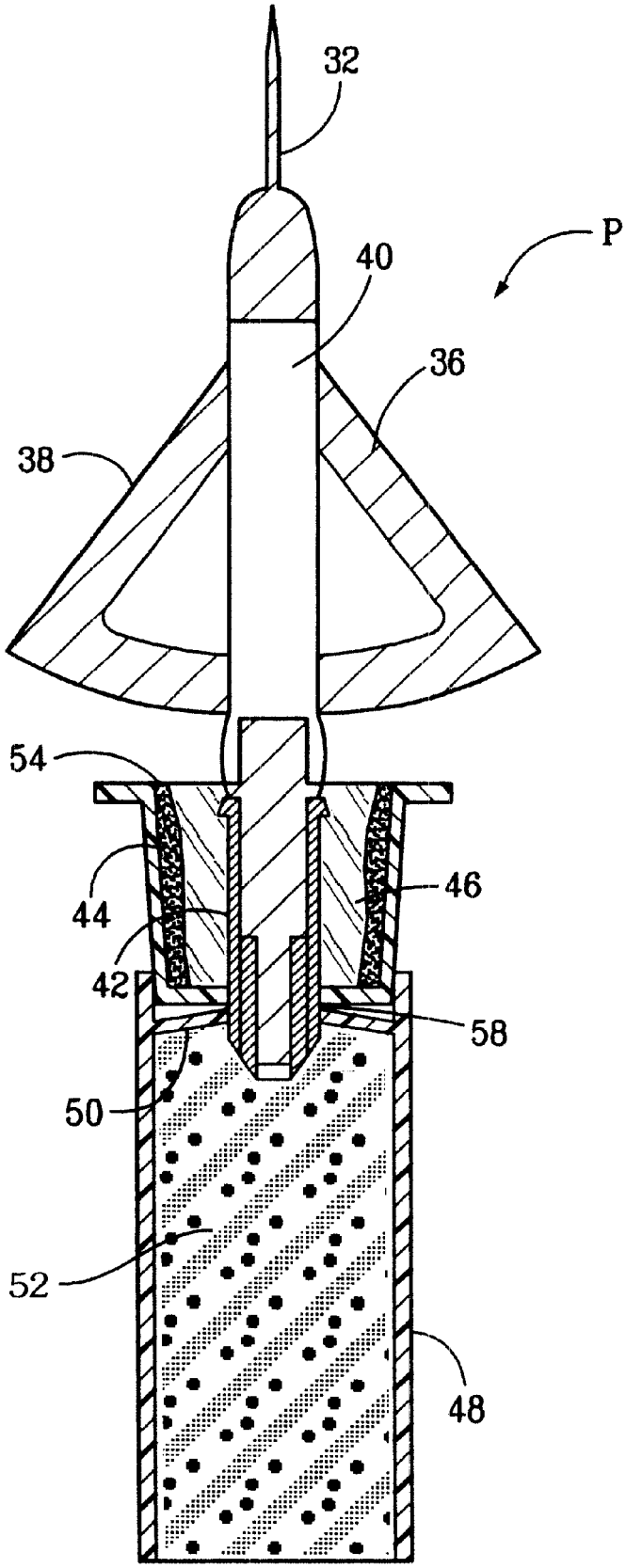
FIG. 4 is a section view along lines 4—4 of FIG. 3.

A projectile P is illustrated in FIGS. 3 and 4. Projectile P is comprised of a slicing portion and a ramming portion. The slicing portion can be a commercially available 125-grain, 4-bladed, razor point arrowhead 28 such as typically used for hunting arrows. The arrowhead is preferably made of hardened steel alloy. The 4-bladed razor point used for the arrowhead 28 is available from Elk Mountain Archery of Colorado Ltd. under the name of Phantom 125. It is also described in U.S. Pat. No. 5,165,697. In a preferred embodiment, the arrowhead 28 has thick blades having thicknesses of 0.038" and 0.028". The blades 30 and 32 have a large base 34 with an example dimension of 1.125". Blades 30 and 32, as well as blades 36 and 38, are secured to a shaft 40. Also connected to shaft 40 is a threaded aluminum sleeve 42 which is typically used for attaching arrowheads to arrow shafts.

The ramming portion provides mass for the projectile through plastic sealing cup 44 and a frangible body such as shot cup 48. Sleeve 42 extends through a hole in the base of cup 44, and cup 44 is secured to sleeve 42 by epoxy 46 distributed therein. The preferred epoxy is a low-viscosity finish cure. Shot cup 48 has a bulkhead 50 at one end having a hole through which aluminum sleeve 42 also extends and is secured within the shot cup 48 by a metal epoxy matrix 52, which is the preferred material for filling the shot cup 48.

In one embodiment, the arrowhead 28 is made of hardened steel alloy and is approximately 2" in length; the blade diameter at the base is approximately 1.125". The angle of blades 30 and 32 is approximately 36°, while the angle of the secondary blades 36 and 38 is approximately 60°. The objective is to have the arrowhead 28 being as wide as possible so that it is capable of producing a cruciform penetration, and as strong as possible to prevent breaking during impact with a steel target. The plastic sealing cup 44 not only contains the epoxy 46 therein, but also further contains foam or balsa expansion strips 54. The epoxy 46 serves the purpose of ensuring a uniform and complete filling of the plastic sealing cup 44 and to adhere to the aluminum sleeve 42. The expansion strips 54 ensure that the tapered plastic sealing cup 44 will give slightly during insertion into the barrel 10 of the PAN disrupter illustrated in FIG. 1 so as to seal the water inside the bore or barrel 16. When the ramming portion hits the penentration formed by the slicing portion, it peels the slices open to form a larger hole through the hardened container.

The plastic sealing cup 44 has indented veins 56 on the outside which allows excess water in the disrupter to pass the sealing cup 44, thus ensuring an air-free filling of the water or other material in the barrel 10. Ultimately, a tight seal for the water or other material in the barrel 10 is assured once the plastic sealing cup 44 is fully secured inside the bore 16 of barrel 10.

In one embodiment, the shot cup 48 is a commercially available 12-gauge plastic nonslit shot cup. It is preferably filled with a mix of low-viscosity epoxy and No. 80 steel shot. The purpose of the epoxy/steel-filled shot cup 48 is to add mass to the projectile P for enhanced penetration. Accordingly, the leading end with the arrowhead 28 and plastic cup 44 is light, while the back end with the shot cup 48 is relatively heavier, and both move toward the target together with identical velocity. The length of the shot cup 48 allows a longer acceleration time in the disrupter barrel 10 to achieve a higher velocity.

The shot cup 48 surrounds the base of the plastic sealing cup 44. The epoxy mix 52 inside the shot cup 48 adheres to the aluminum sleeve 42, but by design requires a minimum force to separate. The weak assembly of the sleeve 42 and the shot cup 48 serves as a frangible link during impact so that the two pieces will separate, ensuring that the hole made by the arrowhead 28 into the target is not plugged by shot cup 48. If plugged, water or other material which serves as a secondary disablement projectile would not be able to pass through into the target. Typically, the total weight of the piercing portion of projectile P is in the order of 38 grams.

When the projectile P of the present invention is analyzed in light of equation (1) above, it can readily be seen that it produces a very short duration shock pulse during impact, which pulse is designed to have insufficient energy to initiate the explosive material of the target. This is accomplished by first impacting the steel container of the target with the very narrow angled (i.e., 30) blades 30 and 32. These blades are very thin, being preferably about 0.038". Initially the thin and narrow blades 30 and 32 correspond to the "d" in equation (1). On impact, the projectile P produces an initial impact pressure at the projectile/target interface. This impact pressure can be transmitted further into the target. Thus, the fact that the diameter d is so small for the arrowhead 28 allows the arrowhead to advance through the steel and into the explosives without generating the sufficient impact pressure time history, $P_i$ due to the thin blades, resulting in a small surface impact area per unit time. The extremely small surface area of the arrowhead 28 allows it to have a correspondingly large diameter offset by its high density. At the same time, this configuration allows the arrowhead 28 to relieve the initial impact pressure very quickly, thus reducing the time the shock energy is imparted into the target. After the pre-shock from the arrowhead, the target will be attacked with a larger diameter (i.e., longer) shock pulse from a lower density (i.e., lower shock-pressure) projectile without shock-initiating the explosive target. It should be recognized that while the effective surface area of cup 44 and shot cup 48 is much larger than the equivalent area of arrowhead 28, the velocity v of cup 44 at the time it impacts the target has been reduced by the impact of arrowhead 28 against the target, and the density ρ of epoxy 46 is much less than the density of steel.

Figure 1:
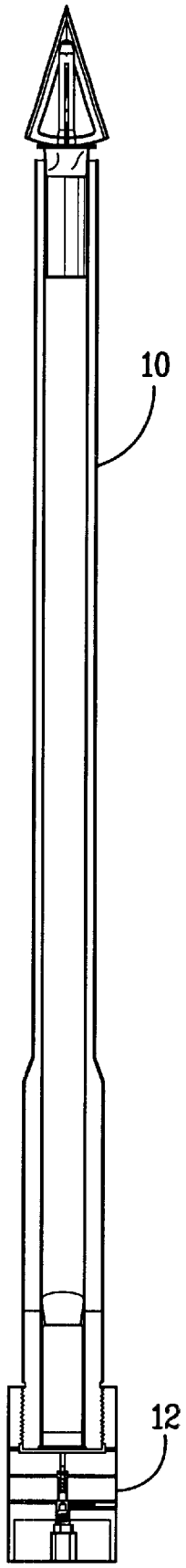
FIG. 1 is a section view of a PAN disrupter, showing the projectile of the present invention mounted therein.
Figure 2:
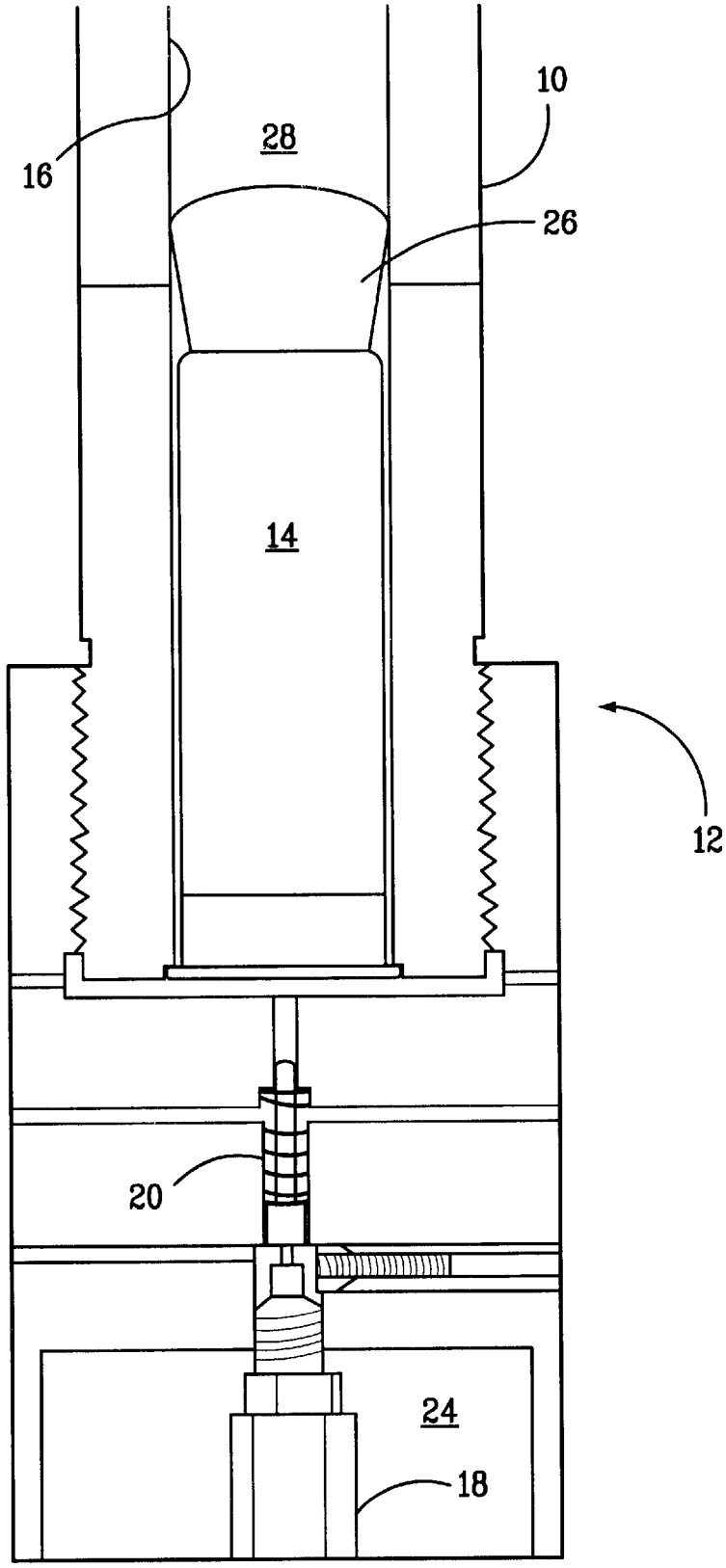
FIG. 2 is a detailed view in section of the PAN disrupter illustrated in FIG. 1.

The disrupter described in FIGS. 1 and 2 can be configured to fire the projectile P in a preferred velocity range of about 100–500 ft/sec at impact. The use of the secondary material, such as the water from the PAN disrupter, is optional. The joint between the shot cup 48 and the remainder of the projectile is made deliberately weak such that upon impact of the arrowhead 28 and penetration through a metal target such as an ammo can and into the IED, the shock caused by the arrowhead being stopped by solid pieces of the IED will cause the connection to break, allowing further advancement of the shot cup 48 into the IED. If shot cup 48 did not break from sleeve 42, it could stop in the hole formed by projectile P, which would prevent the water or other material behind it as fired from the PAN disrupter from penetrating into the IED.

In short, what has been accomplished by the present invention is the ability to penetrate thick housings for IED's without setting off the IED. By the use of an initial projectile in front of water or other material fired from a PAN disrupter, the ability to make a penetration into a fixed steel ammo can or other hardened IED housing without setting off the bomb has been achieved. The projectile itself can be sufficient to disarm the IED or can be used in combination with secondary materials of greater diameter but lower density so as to limit the amplitude of the shock pressure wave generated so that the IED can be further attacked without setting it off. Thus, one of the unique features of the present invention is the initial penetration of the outer container with a very dense projectile which is capable of penetrating steel but yet has a very small diameter so as to minimize the impact pressure time history. The frangible connection between the arrowhead 28 and the rest of the projectile P also facilitates the impact from the secondary material from the PAN disrupter, making further penetration into the target to diffuse the IED.

These projectiles P can be fired from PAN disrupters at close ranges of 1–5 ft and can be brought to the actual IED with remote-controlled vehicles or other types of delivery systems which can allow personnel to remain at a safe distance while the PAN disrupter or disrupters are fired. One or more projectiles P can be fired at the target simultaneously and their firing synchronized to occur within a predetermined time. Additionally, it is also within the scope of the invention to fire one or more projectiles P along with PAN disrupters that fire fluids or other materials without the projectile P. It is anticipated, however, that when the IED is fully enclosed in a fixed steel container, such as a steel drum or an ammo box, that at least one of the projectiles P will be fired at the container to make the initial penetration through the container to allow access to the wiring of the IED to disable it.

The foregoing disclosure and description of the invention are illustrative and explanatory thereof, and various changes in the size, shape and materials, as well as in the details of the illustrated construction, may be made without departing from the spirit of the invention.

What is claimed is:

1. A system for disarming explosive devices within a hard surrounding enclosure, comprising:

a projectile and a body frangibly connected thereto, a leading end of said projectile having a slicing portion formed of a material of sufficiently high density and low surface area to slice the enclosure; and a trailing end of said projectile having a ramming portion of sufficiently lower, density and larger surface area than said leading end to open a hole in said enclosure at the slice without detonating the explosive device;

wherein said body separates from the trailing end of the projectile upon impact of said projectile with the enclosure.

2. The system of claim 1, wherein said leading end comprises a plurality of blades extending from a central shaft.

3. The system of claim 2, wherein said trailing portion comprises a cup surrounding said central shaft, said cup being rigidly affixed to said shaft by epoxy in said cup.

4. The system of claim 1, wherein said leading end comprises a plurality of blades which make a generally cruciform initial penetration.

5. The system of claim 2, wherein said blades comprise at least two circumferentially offset blades.

6. The system of claim 2, wherein said blades comprise at least two longitudinally offset blades.

7. The system of claim 3, wherein said body comprises a tubular member axially aligned with said cup, one end of said tubular member surrounding and being frangibly affixed to an end of said central shaft, said tubular member being filled with a material which adheres to said shaft end.

8. The system of claim 7, wherein the material comprises a metal epoxy matrix.

9. The system of claim 7 further comprising a PAN distrupter for propelling said projectile and body, said PAN disrupter comprising a hollow tube filled with fluid from one end, and firing means at the other end for propelling said fluid from said one end, wherein said body is placed in said tube and said projectile extends from said one end.

10. The system of claim 9 wherein said projectile cup seals said one end of said tube before said PAN disrupter firing means is actuated.

11. The system of claim 1, wherein the leading end weighs less than the body.

12. A method of disarming an explosive device housed in a hard surrounding enclosure, comprising:

firing an PAN disrupter at the enclosure, the disrupter having a charge of fluid that propels a projectile having integral leading slicing and trailing ramming portions the trailing ramming portion including a body frangibly connected thereto, impacting and penetrating the enclosure with said slicing portion with less impulse pressure than required to set off the explosive device;

punching a fragment-free hole in the enclosure with the ramming portion where the slicing portion impacted the enclosure, and passing the charge of fluid through the hole into the enclosure to destroy the explosive device without detonation.

13. The method of claim 12, further comprising firing the projectile at greater than 100 ft./sec.

* * * * *